United States Patent [19]

O'Brien et al.

[11] Patent Number: 4,530,660

[45] Date of Patent: Jul. 23, 1985

[54] ANALYTICAL FURNACE WINDOW ASSEMBLY

[75] Inventors: Larry S. O'Brien, St. Joseph; William R. Strunk, Stevensville, both of Mich.

[73] Assignee: Leco Corporation, St. Joseph, Mich.

[21] Appl. No.: 584,637

[22] Filed: Feb. 29, 1984

[51] Int. Cl.[3] ..... F27D 21/00; B65D 43/20

[52] U.S. Cl. ..... 432/32; 110/173 C; 126/190; 220/345; 432/247

[58] Field of Search ..... 432/32, 247; 126/190; 220/345; 110/173 C

[56] References Cited

U.S. PATENT DOCUMENTS 3,731,035 5/1973 Jarvis et al. ..... 126/190
4,324,223 4/1982 Schwartz ..... 126/190

FOREIGN PATENT DOCUMENTS 1189360 4/1970 United Kingdom ..... 126/190

*Primary Examiner*—John J. Camby
*Attorney, Agent, or Firm*—Price, Heneveld, Huizenga & Cooper

[57] ABSTRACT

The specification discloses a window assembly for an analytical furnace enabling the window to be readily and easily removed and reinstalled to facilitate servicing of the window. The assembly includes a one-piece fused silica housing having concentric inner and outer tube portions. The outer tube portion defines a transverse slot through which a window is inserted to overlie an end of the inner tube. A spring is included to bias the window into engagement with the inner tube to reduce airflow and heat loss therebetween.

13 Claims, 6 Drawing Figures

ANALYTICAL FURNACE WINDOW ASSEMBLY

BACKGROUND OF THE INVENTION

The present invention relates to analytical furnaces, and more particularly to window assemblies for such furnaces.

A wide variety of analytical furnaces have been developed to provide analysis of material samples under controlled atmosphere and temperature. Often, the furnaces include windows permitting the operator to directly or indirectly visually monitor the sample materials during analysis. These windows typically become rapidly contaminated, or fouled, because the sample material components vaporize or otherwise enter the furnace atmosphere during analysis, leaving deposits on the windows. Consequently, the windows must be cleaned relatively frequently to provide the proper clarity required to view the furnace interior.

Known windows are relatively difficult to remove from the furnace for cleaning. In view of the necessitity of cleaning these windows daily in a commercial application, this results in excessive furnace down time and excessive labor to remove the window from the furnace and reinstall the window after cleaning. Further, because access to window assemblies is often aggravated by other portions of the furnace (e.g., heating electrodes, power wiring, and analytical apparatus), removal and reinstallation of the windows is further complicated.

SUMMARY OF THE INVENTION

The aforementioned problems are overcome by the present invention. Essentially, an analytical furnace window assembly is provided permitting the window element to be readily removed and reinserted to facilitate cleaning. The assembly includes a housing mountable within a furnace wall, a window removably mounted within the housing, and a spring for biasing the window into its proper position within the housing. More particularly, the housing is fabricated of fused silica and includes an inner tube including a window supporting end and an outer tube concentric therewith and defining a slot permitting transverse access to the window support. The spring is located within the outer tube and urges the window against the support end of the inner tube to reduce airflow and heat loss therebetween.

The present window assembly permits the rapid and easy removal and reinstallation of the window element therein. When cleaning is required, the window is simply withdrawn from the housing through the slot in the outer tube. After cleaning, the window assembly is reinserted through the slot to a position where the window overlies the inner tube. The spring bias means insures that the window will be properly biased against the inner tube to prevent airflow therebetween.

In a preferred embodiment of the invention, a pressure plate is provided and positioned within the outer tube between the inner tube and the spring. In this embodiment, the window is installed between the pressure plate and the inner tube, and the pressure plate improves the even distribution of the spring force about the periphery of the window to further improve the air seal between the window and inner tube. In a further preferred aspect, the pressure plate includes a lever portion extending outwardly through the slot and engageable by the window during installation to facilitate insertion of the window into the housing.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 2:
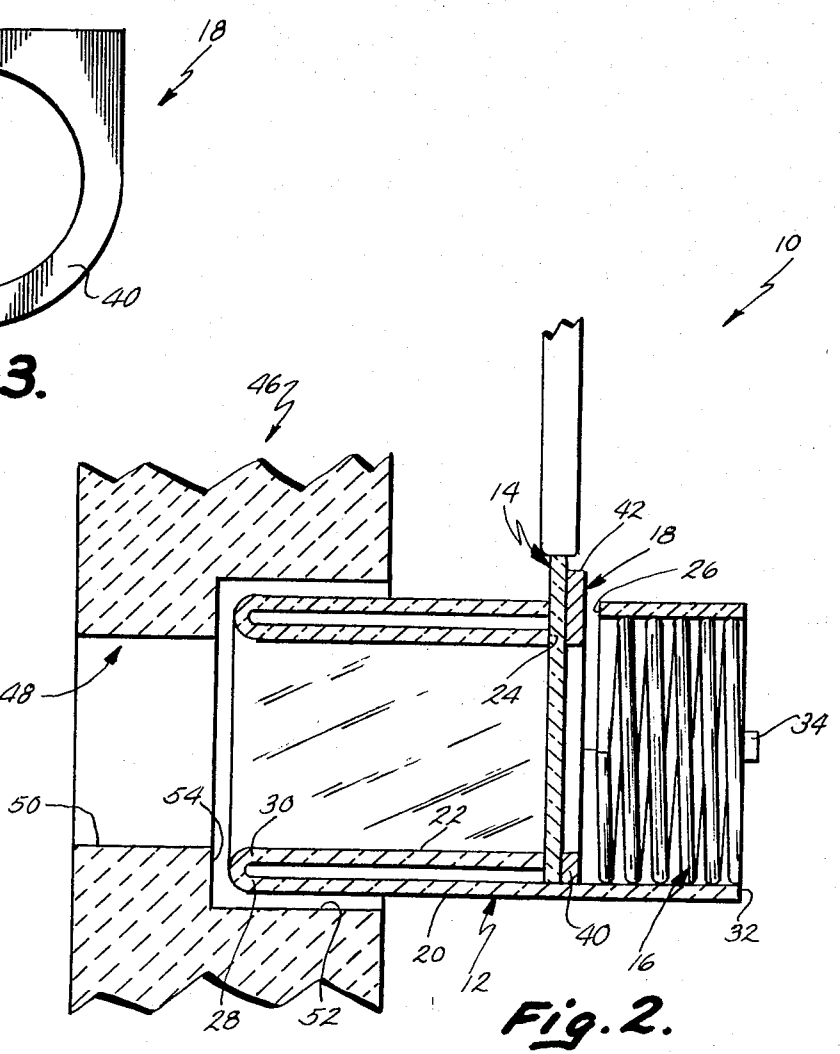
FIG. 2 is a sectional view through the window assembly mounted within a furnace wall.
Figure 1:
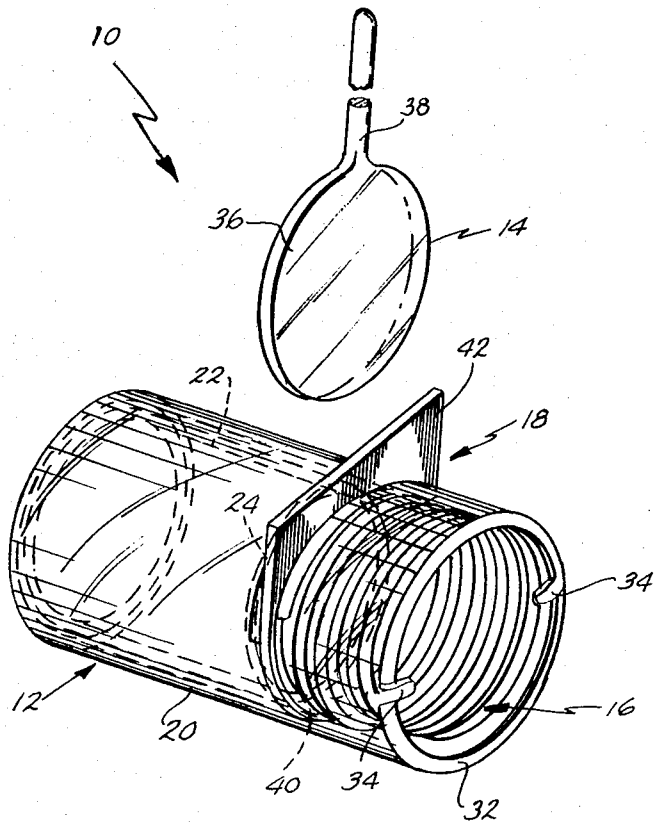
FIG. 1 is a perspective view illustrating the analytical furnace window assembly of the present invention with the window withdrawn from the housing.

An analytical furnace window assembly constructed in accordance with a preferred embodiment of the invention is illustrated in the drawings and generally designated 10. As seen in FIGS. 1 and 2, the assembly generally includes housing 12, window 14 removably mountable within the housing, spring 16 for biasing the window into position, and pressure plate 18 between the window and the spring. Housing 12 in turn includes outer tube 20 and inner tube 22 defining window-support end or surface 24. Outer tube 20 defines slot 26 providing transverse access to window end 24 of inner tube 22. Window 14 is removably insertable through slot 26 to a position proximate or adjacent window end 24. Spring 16 and pressure plate 18 bear against window 14 to maintain the window in position.

Housing 12 is preferably a one-piece element fabricated of fused silica or quartz (FIGS. 1 and 2). The housing includes outer tube 20 and inner tube 22 located generally concentrically therein. Both tubes include furnace ends 28 and 30 respectively which are fused together. Window support end 24 of inner tube 22 is located opposite furnace end 30 and is generally circular, defining a planar abutment surface for window 14. Outer tube 20 includes spring support end 32 generally opposite furnace end 28 which includes a pair of quartz tabs 34 against which spring 16 bears. Tabs 34 may be integral with outer tube 20 or may be added to the outer tube as separate pieces. Slot 26 extends halfway about outer tube 20 and provides access to window end 24 of inner tube 22.

Window 14 (FIGS. 1 and 2) includes window element 36 and stem 38, both fabricated of fused silica or quartz. In the preferred embodiment, handle 38 is approximately three times as long as the diameter of window 36. Of course, the length of handle 38 is in part dependent upon the accessibility of assembly 10 within the furnace as will be described. Window 14 is planar and has an outer diameter approximately the same as the inner diameter of tube 20 to be closely received therein.

Figure 3:
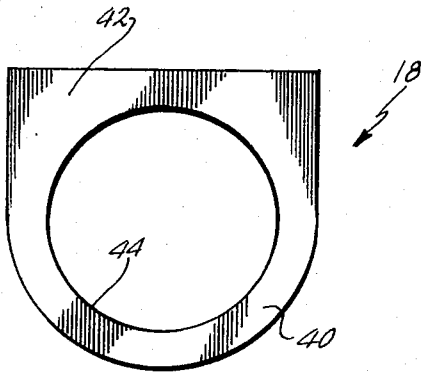
FIG. 3 is a plan view of the pressure plate.

Pressure plate 18 (FIGS. 1–3) is preferably fabricated of stainless steel and includes lower ring portion 40 and upper lever portion 42. Ring portion 40 is generally semicircular having an outer radius approximately equal to the inner radius of outer tube 20. Consequently, when pressure plate 18 is positioned within housing 12, ring 40 abuts tube 20 about their lower peripheries. Lever portion 42 extends outwardly from housing 12 (see FIG. 1) to be engageable by window 14 during installation of the window element. Pressure plate 18 defines an aperture 44 having a diameter approximately equal to the internal diameter of inner tube 22.

Spring 16 (FIGS. 1 and 2) is a coil spring extending between tabs 34 and pressure plate 18. Preferably, the diameter of spring 16 is slightly smaller than the internal diameter of tube 22 such that the spring is closely received therein. Spring 16 provides a spring force of approximately two pounds to urge retainer plate 18 toward window support surface 24. In the preferred embodiment, spring 16 is fabricated of a high-temperature alloy and most preferably from chrome valadium, comprising:

| Component | Amount |
|---|---|
| Carbon | 45–55 |
| Manganese | 7–9 |
| Phosphorus | 4 max |
| Sulfur | 4 max |
| Silicon | 20–35 |
| Chrome | 80–110 |
| Valadium | 10 min |

INSTALLATION AND OPERATION

Window assembly 10 is formed by first fabricating housing 12 from a single piece of tubular fused silica, which is turned or folded inwardly upon itself to form inner tube 22 within outer tube 20. Slot 26 is formed after this folding operation to provide transverse access to window support edge 24. Tabs 34 are formed preferably by integrally lancing portions of the quartz tube inwardly toward each other or optionally by adding separate pieces of fused quartz to furnace end 32 of outer tube 20. Pressure plate 18 is inserted through slots 26 to abut window support edge 24, and spring 16 then is positioned between pressure plate 18 and tabs 34. At this point of assembly, housing 12 is prepared for insertion in furnace wall 46.

Window assembly 10 is mounted within furnace wall 46 (FIG. 2) in view port 48, which includes two stepped portions 50 and 52 defining shoulder 54. Housing 12 is inserted within view port 48 by inserting the housing into counterbore 52 until furnace ends 28 and 30 abut shoulder 54. Preferably, housing 12 is sealed within furnace wall 46 with a ceramic putty (not shown), for example that sold under the trademark THERMEEZ by Cotronics Corporation, of Brooklyn, New York.

Figure 4:
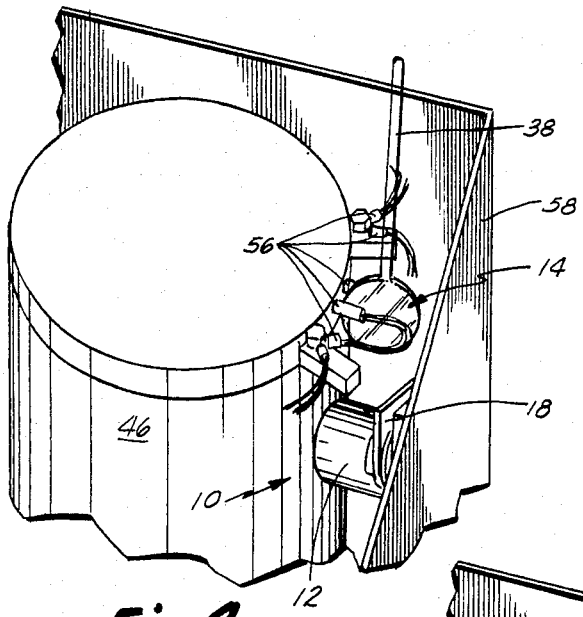
FIG. 4 is a perspective view of a furnace including the window assembly with the window withdrawn from the housing.
Figure 5:
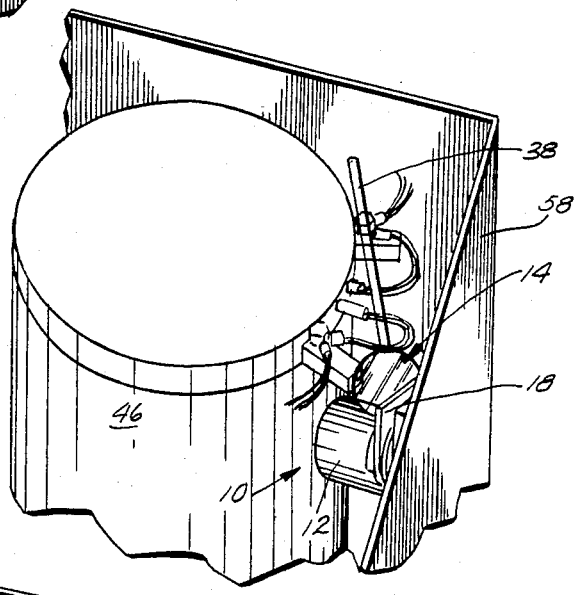
FIG. 5 is a perspective view similar to FIG. 4 with the window assembly initially engaging the pressure plate.
Figure 6:
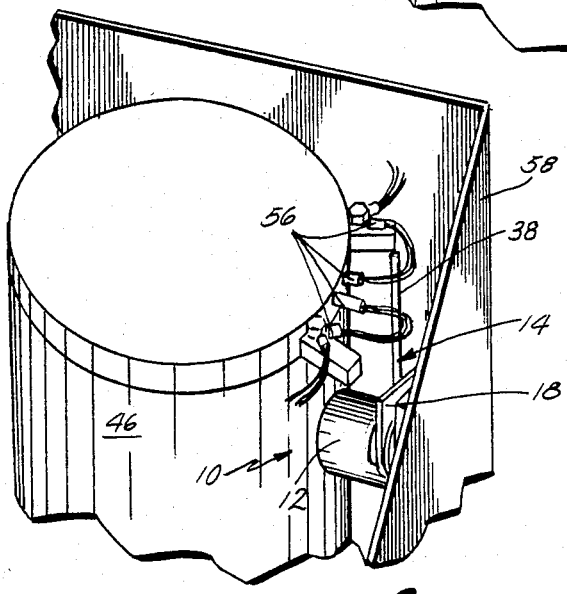
FIG. 6 is a perspective view similar to FIG. 4 showing the window installed within the housing.

After housing 12 is properly installed within furnace wall 46, the housing appears as illustrated in FIGS. 4–6. The furnace will additionally include components, such as heating electrodes 56 and housing 58, restricting access to window assembly 10.

Window 14 is readily installed within housing 12 as illustrated in FIGS. 4–6. The operator installs window 14 by grasping stem 38 and guiding the window between electrodes 56 and housing 58 (FIG. 4). Retainer portion 42 of pressure plate 18 extending from the housing 12 is engaged by window 14 (FIG. 5) to press the pressure plate rearwardly providing a gap into which the window can be inserted in slot 26 adjacent pressure plate 18. Window 14 is then slid downwardly until fully seated against outer tube 20 (FIG. 6). When stem 38 is released, spring 16 will urge pressure plate 18 and window 14 forwardly such that the window engages and substantially seats against window support edge 24 of inner tube 22 (see FIG. 2).

The interior of the furnace can be clearly viewed through assembly 10 and more particularly through window 14 positioned therein. The diameter of spring 16 and aperture 44 in pressure plate 18 provide an unobstructed view through window 14 and inner tube 22. When the window requires servicing, for example cleaning, the operator simply grasps stem 38 and withdraws the window from housing 12 and from between electrodes 56. After the window is cleaned or scoured as necessary, the window is rapidly and easily reinstalled as described above.

The window assembly of the present invention permits the rapid and easy removal and reinstallation of the window member within the assembly. Consequently, cleaning is greatly facilitated, resulting in reduced furnace down time and reduced labor. Further, the operator is inclined to clean the window more frequently because of the relative ease of the cleaning operation, permitting the more accurate observation of the furnace interior.

The above description is that of a preferred embodiment of the invention. Various changes and alterations can be made without departing from the spirit and broader aspects of the invention as set forth in the appended claims, which are to be interpreted in accordance with the principles of patent law, including the doctrine of equivalents.

The embodiments of the invention in which an exclusive property of privilege is claimed are defined as follows:

1. An analytical furnace window assembly comprising:
   - an inner tube including a furnace end and an opposite window end;
   - an outer tube positioned about said inner tube, said outer tube defining slot means for permitting transverse access to said window end of said inner tube through said outer tube;
   - a window installable through said transverse slot to a position overlying said window end; and
   - bias means for biasing said window against said window end when said window is installed within said slot.

2. A window assembly as defined in claim 1 wherein said inner tube and outer tube comprise a single piece of fused silica.

3. A window assembly as defined in claim 1 wherein said window end and said window are substantially planar and further wherein said window seats against the entire periphery of said window end to substantially eliminate airflow therebetween.

4. A window assembly as defined in claim 1 wherein said bias means comprises a spring and a pressure plate positioned between said spring and said window end, said pressure plate including a catch portion extending outwardly through said outer tube slot.

5. A window assembly as defined in claim 1 wherein said window comprises an elongated handle extending therefrom to facilitate installation of said window within said assembly.

6. An analytical furnace window assembly comprising:
   - a one-piece fused silica housing including an inner tube portion having a furnace end and an opposite window end, said housing further including an outer tube portion having a furnace end and an opposite spring end, said inner and outer tube portions being fused together at their furnace ends, said outer tube defining a slot permitting access to said window end through said outer tube portion;

a window removably insertable through said slot to a position adjacent said window end; and spring means extending between said spring end and said window for biasing said window into engagement with said window end.

7. A window assembly as defined in claim 6 wherein said window end and said window are substantially planar and further wherein said window seats against the entire periphery of said window end to prevent substantial air movement therebetween when said window engages said window end.

8. A window assembly as defined in claim 7 wherein said window end and said window are both substantially planar.

9. A window assembly as defined in claim 8 further comprising a pressure plate between said window end and said spring means.

10. A window assembly as defined in claim 9 wherein said pressure plate comprises a lever portion extending out of said housing through said slot means to provide a means for biasing said spring means to facilitate insertion of said window between said spring means and said window end.

11. A window assembly as defined in claim 6 further comprising a pressure plate between said window end and said spring means.

12. A window assembly as defined in claim 11 wherein said pressure plate comprises a lever portion extending out of said housing through said slot means to provide a means for biasing said spring means to facilitate insertion of said window between said spring means and said window end.

13. A window assembly as defined in claim 6 wherein said window comprises an elongated handle portion extending therefrom to facilitate insertion of said window into said housing.

* * * * *